US005355857A

United States Patent [19]

Naumann et al.

[11] Patent Number: 5,355,857

[45] Date of Patent: Oct. 18, 1994

[54] FUEL INJECTION PUMP FOR INTERNAL COMBUSTION ENGINES

[75] Inventors: Werner Naumann, Eppelborn; Hannes Pflug, Weilderstadt; Wolfgang Braun, Ditzingen; Wolfgang Fehlmann; Dieter Junger, both of Stuttgart; Joachim Kurz, Muehlacker, all of Fed. Rep. of Germany

[73] Assignee: Robert Bosch GmbH, Stuttgart, Fed. Rep. of Germany

[21] Appl. No.: 105,715

[22] Filed: Aug. 12, 1993

[30] Foreign Application Priority Data

Sep. 30, 1992 [DE] Fed. Rep. of Germany ..... 4232741

[51] Int. Cl.[5] ..... F02M 41/00; F02M 37/04

[52] U.S. Cl. ..... 123/449; 123/503

[58] Field of Search ..... 123/449, 503, 501, 500, 123/373, 506, 458, 495

[56] References Cited

U.S. PATENT DOCUMENTS

| | | | |
|---|---|---|---|
| 3,896,779 | 7/1975 | Omori | 123/449 |
| 4,395,987 | 8/1983 | Kobayashi | 123/506 |
| 4,505,247 | 3/1985 | Niega | 123/449 |
| 4,561,398 | 12/1985 | Nierga | 123/503 |
| 4,593,668 | 6/1986 | Yuzawa | 123/503 |
| 5,205,262 | 4/1993 | Anton | 123/506 |

FOREIGN PATENT DOCUMENTS

| | | | |
|---|---|---|---|
| 202463 | 3/1956 | Australia | 123/449 |
| 0480173 | 4/1992 | European Pat. Off. . | |
| 0088957 | 7/1981 | Japan | 123/449 |
| 0018242 | 1/1984 | Japan | 123/503 |

*Primary Examiner*—Carl S. Miller
*Attorney, Agent, or Firm*—Michael J. Striker

[57] ABSTRACT

A fuel injection pump for internal combustion engines has a pump housing, at least one pump piston which is rotatable and reciprocatingly movable, a cam drive which rotates and reciprocatingly moves the pump piston and includes a stationary part and a rotatable part, a fixing element which determines a rotary position of the stationary part and also radially engages the stationary part and is fixed tangentially to the stationary part, a valve operative for loading a pump working chamber limited by the pump piston during a feed stroke of the pump piston for controlling an injection-active pump piston stroke, and a mounting element which releasably mounts the fixing element on an inner side of a part of the pump housing.

8 Claims, 2 Drawing Sheets

FUEL INJECTION PUMP FOR INTERNAL COMBUSTION ENGINES

BACKGROUND OF THE INVENTION

The present invention relates to fuel injection pumps for internal combustion engines, and in particular to a fuel injection pump which has a cam drive which simultaneously rotates and reciprocates a pump piston and has a stationary part and a part rotatably driven by a drive shaft.

Fuel injection pumps of the above-mentioned general type are known in the art. One such fuel injection pump is disclosed for example in the German patent document GM 90 14 068. The fuel injection pump disclosed in this reference has a pump piston which is rotatable and reciprocatingly movable by a cam drive and which limits a pump working chamber. The cam drive includes a stationary part which is formed as a roller ring and a part which is rotatable by a drive shaft and formed as a cam disk. The rotary position of the stationary part is fixed by a fixing element which engages in the stationary part, is supported in a sliding piece and forms as a pin. The sliding piece is guided in a pump housing tangentially to the stationary part with a small gap, so that the rotary position of the stationary part is fixed with a small gap. The fuel injection pump further has an electrically controlled valve which is operative for loading the pump working chamber during the pumping stroke of the pump piston for controlling the injection-active pump piston stroke. The time point of the closing of the valve is also controlled for controlling the injection start in dependence upon the operational parameters of the internal combustion engine. The fuel injection pump has the disadvantage that the sliding piece and the pin during their mounting are not visible, so that their mounting is difficult. Moreover, the machining of the receptacle for the sliding piece is difficult since it is arranged in a location in the pump housing which is not easily accessible. The pin is secured in the stationary part additionally by a rod, so that three structural parts are required for fixing the rotary position of the stationary part. Also, two fits, namely between the pin and the stationary part and between the sliding piece and its receptacle are provided, and they must be produced with high accuracy. It is to be understood that it is desirable to eliminate these disadvantages in the sense of an efficient manufacture and simple mounting.

SUMMARY OF THE INVENTION

Accordingly, it is an object of the present invention to provide a fuel injection pump for internal combustion engines, which avoids the disadvantages of the prior art.

In keeping with these objects and with others which will become apparent hereinafter, one feature of the present invention resides, briefly stated, in a fuel injection pump in which the fixing element which fixes the rotary position of the stationary part is releasably mounted on the inner side of a pump housing part by means of a mounting element.

When the fuel injection pump is designed in accordance with the present invention, the fixing element inside the pump housing is easily accessible when the housing part is removed, so that its mounting is simple and moreover a machining of the receptacle for it is easy.

Moreover, for the fixing of the rotary position of the stationary part, only the fixing element and the mounting element are needed, and between the fixing element and the stationary part an exactly produced fit is available while the fixing element is held by the mounting element.

In accordance with another feature of the present invention, the fixing element is disk-shaped and abuts with a plane abutment face on a plane face of the inner side of the pump housing part and held on the latter by the mounting element, wherein the outer surface of the stationary part is provided with a recess for engaging the fixing element. In this construction the fixing element can be produced in an especially simply manner and due to its position on the flat surface of the pump housing part takes high forces without bending moments.

In a fuel injection pump with electrical regulation, often a rotary transducer is provided for determination, for example, of the rotary speed and the rotary position of the drive shaft. In order to arrange and mount such a rotary transducer, the fuel injection pump has a removable housing part through which the fixing element is accessible. Therefore, no additional partition of the pump housing and no additional sealing are required.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
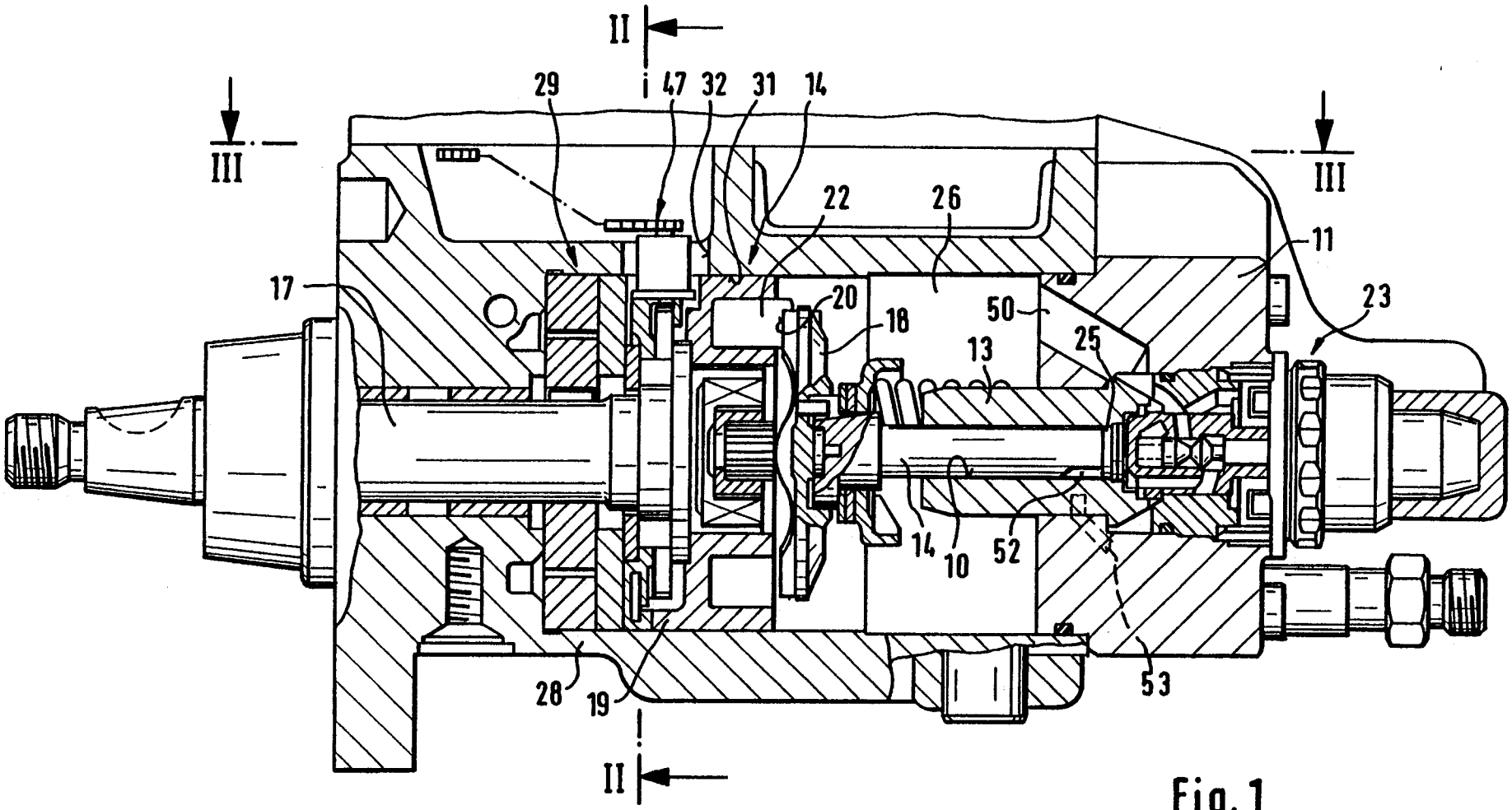
FIG. 1 is a view showing a longitudinal section of a fuel injection pump in accordance with the present invention.
Figure 2:
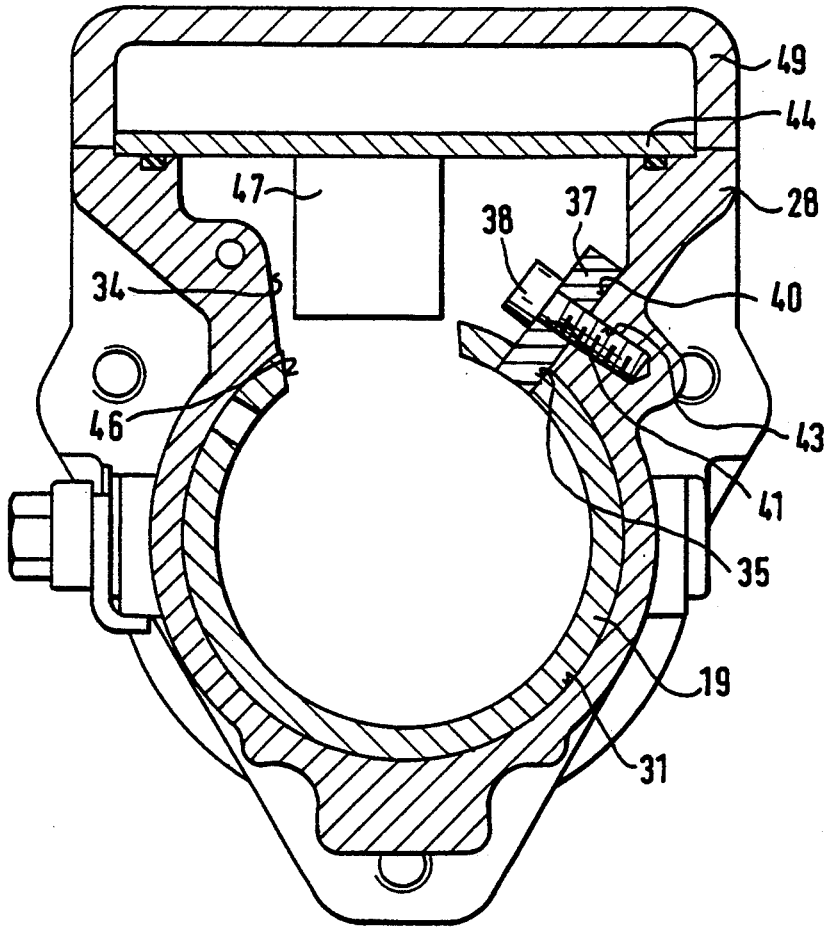
FIG. 2 is a view showing a transverse section taken along the line II—II in FIG. 1.
Figure 3:
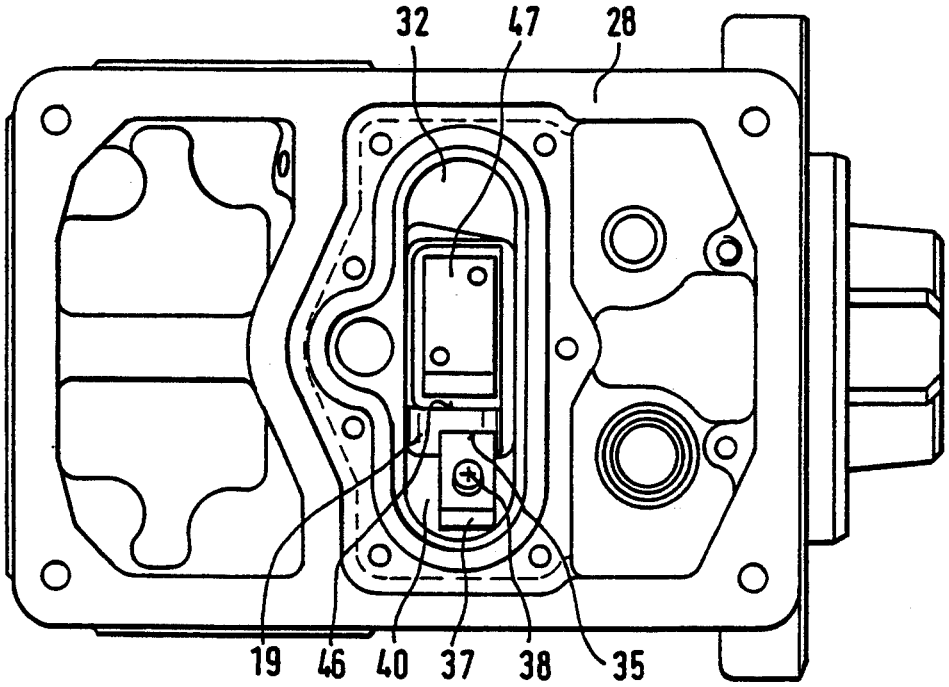
FIG. 3 is a view showing a longitudinal section along the line III—III in FIG. 1.

A fuel injection pump for internal combustion engines shown in FIGS. 1–3 is formed as a distributor-type pump. It has a pump housing 11 formed as a distributor body, a bushing 13 inserted in the pump housing 11 and having a cylindrical opening 10, and a pump piston 14 operating in the cylindrical opening. The pump piston 14 is reciprocatingly movable and simultaneously rotatable by a cam drive 16.

The cam drive 16 includes a rotatable part which is formed as a cam disk 18 coupled with a drive shaft 17 of the fuel injection pump, and a stationary part formed as a roller ring 19. The cam disk 18 has a cam path with star-cam elevations 20 abutting against rollers 22 which are held in the roller ring 19. The pump piston 14 on one hand and an electrically controlled valve 23 inserted in the distributor body 11 on the other hand limit a pump working chamber 25 in the cylindrical opening 20. An inner chamber 26 which is limited by the distributor body 11 and a further pump housing part 28 is filled with fuel by a feed pump 29 integrated in the fuel injection pump. It operates as a suction chamber from which the pump working chamber 25 is supplied with fuel.

The roller ring 19 has a cylindrical outer periphery 30 with which it is supported in an opening 31 of the pump housing part 28 radially with a small gap [play]. The opening 31 opens into the pump housing part 28 through a recess 32 as shown above in FIG. 2, and the pump housing part has edges 34. The roller ring 19 is provided in its outer periphery 30 with an axial recess 35, and a fixed element 37 engages in the recess 35 radially with a small gap. On the other hand, the fixing element 37 is mounted by a mounting element 38 on the inner side of the pump housing part 28. The recess 35 can be formed as a slot which extends from the end region of the roller ring 19 facing the cam disk 18, but does not reach an opposite end region. The fixing element 37 is preferably formed as a substantially flat disk. The flat disk over a greater part of its length lies on a corresponding flat surface 40 which extends radially to the roller ring 19 on the inner side of the pump housing part 28. The flat surface 40 is preferably arranged on one edge 34 of the recess 32.

The mounting element 38 can be formed as a screw which extends through an opening 41 substantially in the center both of the longitudinal extension and the transverse extension of the disk 37 through the disk and is screwed into a threaded opening 43 in the pump housing part 28. The forces which act on the roller ring 19 during the injection process are absorbed by the fixing element 37. Since only a small gap is available between the roller ring 19 and the opening 31, the forces acting on the roller ring 19 produce only a small lever arm during the action on the fixing element 37, so that it experiences only a relatively small loading for bending.

The recess 32 is closable by a cover-shaped pump housing part 44. The roller ring 19 in the region of the recess 32 is also provided with a recess 46 through which the end region of the drive shaft 17 is released. A rotary transducer 47 is arranged in the recess 32 and operates for determination of the rotary speed and the rotary position of the drive shaft 17. The rotary transducer is connected with a not-shown control device. The pump housing part 44 is provided for closing the recess 32. A further cover 49 can be provided over the pump housing part 44 for protecting the electrical conduits which lead from the rotary transducer 47. When the cover 49, the housing part 44 and the rotary transducer 47 are removed, the fixing element 37 and the mounting element 38 are visible and accessible through the recess 32. The flat surface 40 as well as the threaded opening 43 can be simply machined for manufacturing the fuel injection pump.

The fuel injection pump in accordance with the present invention operates in the following manner.

The valve 23 controls a communication of the inner chamber 26 with the pump working chamber 25. During the suction stroke of the pump piston 14 the valve 23 is open and the fuel flows from the inner chamber 26 through a passage 50 as well as the valve 23 into the pump working chamber 25. During the pressure stroke of the pump piston 14, the valve 23 is closed during a period of the selected high pressure supply of the pump piston 14, and the fuel under the high pressure is supplied through a distributor opening 52 at the periphery of the pump piston 14 in the corresponding rotary position of the pump piston 14 into feed passages 53 identified by a broken line and connected through injection conduits with injection points of the internal combustion engine. The closing time and thereby the high pressure injection quantity as well as the closing point of the valve 23 which determines a start of the high pressure injection phase is determined by the control device. The control device can evaluate, in addition to the values detected by the rotary transducer 47, also further operational parameters of the internal combustion engine, such as for example, load, temperature, etc.

It will be understood that each of the elements described above, or two or more together, may also find a useful application in other types of constructions differing from the types described above.

While the invention has been illustrated and described as embodied in a fuel injection pump for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

what is claimed as new and desired to be protected by Letters Patent is set forth in the appended claims.

1. A fuel injection pump for internal combustion engines, comprising a pump housing which has an interior space; at least one pump piston which is rotatable and reciprocatingly movable in said interior space; a cam drive which rotates and reciprocatingly moves said pump piston, said cam drive having a stationary part and a rotatable part; a fixing element which determines a rotary position of said stationary part, said fixing element radially engaging said stationary part and being fixed circumferentially to said stationary part to prevent turning of said stationary part, said pump piston limiting a pump working chamber; a valve operative for loading said pump working chamber during a feed stroke of said pump piston for controlling an injection-active pump piston stroke, said valve having a controlled time point of its closing in order to control an injection start in dependence upon operational parameters of the internal combustion engine; and a mounting element which releasably mounts said fixing element in said interior space of said pump housing on an inner side of a part of said pump housing.

2. A fuel injection pump for internal combustion engines, comprising a pump housing; at least one pump piston which is rotatable and reciprocatingly movable; a cam drive which rotates and reciprocatingly moves said pump piston, said cam drive having a stationary part and a rotatable part; a fixing element which determines a rotary position of said stationary part, said fixing element radially engaging said stationary part and being fixed circumferentially relative to said stationary part to prevent turning of said stationary part, said pump piston limiting a pump working chamber; a valve operative for loading said pump working chamber during a feed stroke of said pump piston for controlling an injection-active pump piston stroke, said valve having a controlled time point of its closing in order to control an injection start in dependence upon operational parameters of the internal combustion engine; and a mounting element which releasably mounts said fixing element on an inner side of a part of said pump housing, said inner side of said part of said pump housing having a substantially flat surface, said fixing element being disk-shaped and provided with a substantially flat abutment surface which lies on said substantially flat surface of said inner side of said part of said pump housing, said mounting element holding said fixing element on said substantially flat surface of said inner side of said part of said pump housing.

3. A fuel injection pump for internal combustion engines, comprising a pump housing; at least one pump piston which is rotatable and reciprocatingly movable; a cam drive which rotates and reciprocatingly moves said pump piston, said cam drive having a stationary part and a rotatable part; a fixing element which determines a rotary position of said stationary part, said fixing element radially engaging said stationary part and being fixed circumferentially relative to said stationary part to prevent turning of said stationary part, said pump piston limiting a pump working chamber; a valve operative for loading said pump working chamber during a feed stroke of said pump piston for controlling an injection-active pump piston stroke, said valve having a controlled time point of its closing in order to control an injection start in dependence upon operational parameters of the internal combustion engine; and a mounting element which releasably mounts said fixing element on an inner side of a part of said pump housing, said part of said pump housing having a passage in which said stationary part is radially supported, said passage having a lateral opening with an edge arranged radially to said stationary part, said fixing element being mounted on said edge.

4. A fuel injection pump for internal combustion engines, comprising a pump housing; at least one pump piston which is rotatable and reciprocatingly movable; a cam drive which rotates and reciprocatingly moves said pump piston, said cam drive having a stationary part and a rotatable part; a fixing element which determines a rotary position of said stationary part, said fixing element radially engaging said stationary part and being fixed tangentially relative to said stationary part to prevent turning of said stationary part, said pump piston limiting a pump working chamber; a valve operative for loading said pump working chamber during a feed stroke of said pump piston for controlling an injection-active pump piston stroke, said valve having a controlled time point of its closing in order to control an injection start in dependence upon operational parameters of the internal combustion engine; and a mounting element which releasably mounts said fixing element on an inner side of a part of said pump housing, said fixing element being completely located inside said pump housing.

5. A fuel injection pump as defined in claim 1; and further comprising a drive shaft which rotates said rotatable part of said cam drive.

6. A fuel injection pump as defined in claim 2, wherein said stationary part has an outer surface provided with a recess, said fixing element engaging in said recess of said outer surface of said stationary part.

7. A fuel injection pump as defined in claim 3, wherein said lateral opening has an outlet permitting an insertion of said mounting element; and further comprising a cover which covers said outlet.

8. A fuel injection pump as defined in claim 3; and further comprising a rotary transducer arranged in said lateral opening.

* * * * *